US005913276A

United States Patent [19]

Kurono et al.

[11] Patent Number: 5,913,276

[45] Date of Patent: Jun. 22, 1999

[54] MULTIHEAD SEWING MACHINE WITH IMPROVED SHUTTLE DRIVE CONTROL

[75] Inventors: Yoshikazu Kurono, Hazu-gun; Masaki Shimizu, Toyoake; Hirokazu Hirose, Chiryu, all of Japan

[73] Assignee: Brother Kogyo Kabushiki Kaisha, Nagoya, Japan

[21] Appl. No.: 09/039,413

[22] Filed: Mar. 16, 1998

[30] Foreign Application Priority Data

Mar. 28, 1997 [JP] Japan ..... 9-095093

[51] Int. Cl.[6] ..... D05B 19/12; D05B 57/36; D05B 69/18; D05B 21/00

[52] U.S. Cl. ..... 112/470.01; 112/155; 112/220; 112/275

[58] Field of Search ..... 112/470.01, 275, 112/277, 220, 221, 155, 163, 181, 102.5, 470.04, 300, 167

[56] References Cited

U.S. PATENT DOCUMENTS 5,458,075 10/1995 Tice et al. .
5,791,274 8/1998 Akahane et al. ..... 112/470.04
5,794,554 8/1998 Akahane et al. ..... 112/470.01

FOREIGN PATENT DOCUMENTS

B2-60-21750 5/1985 Japan .
A-3-234291 10/1991 Japan .
A-9-248392 9/1997 Japan .

*Primary Examiner*—Peter Nerbun
*Attorney, Agent, or Firm*—Oliff & Berridge, PLC

[57] ABSTRACT

A multihead sewing machine includes a sewing machine motor, a main shaft rotated by the sewing machine motor, a plurality of sewing needles driven by the main shaft, a plurality of shuttles for capturing thread loops in cooperation with the sewing needles respectively, each shuttle having a hook shaft, and a plurality of shuttle driving motors for rotating the hook shafts of the shuttles independent of the sewing machine motor respectively. The sewing machine motor and the shuttle driving motors are controlled so that the sewing machine motor and each shuttle driving motor are rotated in synchronism with each other. Loss of synchronism of each shuttle relative to the corresponding sewing needle is detected. Rotation of the main shaft is stopped in an abnormal condition in which the loss of synchronism has been detected with respect to at least one of the shuttles. Furthermore, at least the shuttle driving motor or motors other than the shuttle driving motor regarding which the loss of synchronism has been detected are rotated in synchronism with the main shaft until rotation of the main shaft stops.

15 Claims, 14 Drawing Sheets

MULTIHEAD SEWING MACHINE WITH IMPROVED SHUTTLE DRIVE CONTROL

BACKGROUND OF THE INVENTION

1. Field of the Invention

This invention relates to a multihead sewing machine including a sewing machine motor for driving a main shaft further driving a plurality of sewing needles, and a plurality of shuttle driving motors for driving a plurality of shuttles for capturing thread loops in cooperation with the sewing needles respectively.

2. Description of the Related Art

There have conventionally been provided vertical axis drive type sewing machines comprising a single sewing machine motor for driving both a main shaft for vertically driving sewing needles and thread take-up levers, and a lower shaft for driving thread loop capturing shuttles such as full-turn shuttles. On the other hand, Japanese patent publication Nos. 60-21750-B and 3-234291-A each disclose a hook shaft independent drive type sewing machine comprising an independent shuttle driving motor for driving a thread loop capturing shuttle as well as a sewing machine motor for driving a main shaft. In the independent hook shaft drive type sewing machines, the sewing machine motor and the shuttle driving motor are controlled so that the shuttle is driven in synchronism with the main shaft of the machine. Furthermore, the shuttle is controlled to be driven according to various sewing conditions.

In the hook shaft independent drive type sewing machines, various countermeasures have been proposed to prevent loss of synchronism between the needles and the shuttles when the main shaft is manually rotated. However, no technique has been proposed to detect an amount of displacement due to the loss of synchronism caused during the sewing operation. Furthermore, no countermeasures have been known to be taken when the amount of displacement has exceeded an allowed value. In view of these circumstances, the assignee of the present invention filed a patent application in Japan for the invention relating to a sewing machine provided with the above-described countermeasures, and the application was assigned Japanese patent application No. 8-85917.

The above-mentioned Japanese patent application No. 8-85917 discloses a multihead embroidery machine provided with three sewing machine units and comprising a sewing machine motor for driving a main shaft further driving sewing needles of the sewing machine units simultaneously, thread loop capturing shuttles provided in cylindrical sewing beds of the heads, and shuttle driving motors provided in the sewing beds for driving hook shafts of the shuttles, respectively. In this construction, each hook shaft is controlled to be driven in synchronism with rotation of the main shaft in a normal sewing. In a case where thread jamming etc. desynchronizes any one of the three shuttles during the sewing, loss of synchronism is detected when an amount of displacement of the hook shaft with respect to the main shaft reaches a predetermined value. Upon detection of the loss of synchronism, emergency stop of the machine motor is effected, and a needle bar jumping mechanism is actuated to jump a needle bar of each head up to its uppermost position. Furthermore, each shuttle driving motor is stopped. Consequently, the sewing needles can be prevented from colliding against the respective shuttles.

In the above-described multihead embroidery machine, the sewing machine motor and the shuttle driving motors differ from one another in a driving force, load inertia, etc.

Accordingly, the machine motor and each shuttle driving motor cannot be stopped in emergency simultaneously. Furthermore, a timing for jumping each needle bar lags behind. Consequently, loss of synchronism of each hook shaft with respect to the main shaft may result in collision of each needle against the corresponding shuttle in the emergency stop. This poses a problem.

In the above-described multihead embroidery machine, furthermore, the emergency stop sometimes causes the main shaft and each shuttle to assume respective rotational positions which are not predetermined ones for the start of the sewing, for example, respective positions at which a needle thread loop is formed on each shuttle with the thread take-up lever remaining in the lowered state. In this case, a manually operated pulley is driven so that the main shaft is rotated to assume a sewing start position which is away about 100 degrees from an original position, the sewing start position at which the thread take-up lever is lifted so that the thread is tightened up. Since the shuttle driving motor is stopped, the thread take-up lever is lifted up with the needle thread loop being formed on the shuttle, whereupon the needle thread loop remains below a throat plate. Thereafter, upon instruction of re-start of the sewing, initializing processes are executed in which each shuttle is rotated to assume the sewing start position, and subsequently, the sewing is re-started. However, the needle thread loop remaining below the throat plate may be caught by the rotating shuttle. This would result in thread jamming or prevent rotation of the shuttle, posing a problem.

SUMMARY OF THE INVENTION

Therefore, an object of the present invention is to provide a multihead sewing machine in which on the occasion of the loss of synchronism of the shuttle due to thread jamming etc., the sewing machine motor and the shuttle driving motors can be stopped so that the sewing needles are prevented from collision against the shuttles, and the thread jamming etc. can be prevented when the sewing is re-started after the emergency stop.

The present invention provides a multihead sewing machine comprising a sewing machine motor, a main shaft rotated by the sewing machine motor, a plurality of sewing needles driven by the main shaft, a plurality of shuttles for capturing thread loops in cooperation with the sewing needles respectively, each shuttle having a hook shaft, a plurality of shuttle driving motors for rotating the hook shafts of the shuttles independent of the sewing machine motor respectively, sewing control means for controlling the sewing machine motor and the shuttle driving motors so that the sewing machine motor and each shuttle driving motor are rotated in synchronism with each other, loss-of-synchronism detecting means for detecting loss of synchronism of each shuttle relative to the corresponding sewing needle, and emergency stop control means for instructing the sewing control means to stop rotation of the main shaft in an abnormal condition wherein the loss of synchronism has been detected with respect to at least one of the shuttles by the loss-of-synchronism detecting means, the emergency stop control means further instructing the sewing control means to rotate, in synchronism with the main shaft, at least the shuttle driving motor or motors other than the shuttle driving motor regarding which the loss of synchronism has been detected, until rotation of the main shaft stops.

According to the above-described multihead sewing machine, upon start of the sewing, the sewing machine motor and the shuttle driving motors are controlled by the sewing control means to be rotated in synchronism with each other, so that sewing processes are executed. Upon detection of loss of synchronism of at least one shuttle relative to the corresponding sewing needle during the sewing (the abnormal condition), the sewing control means is instructed to stop rotation of the main shaft and to rotate, in synchronism with the main shaft, at least the shuttle driving motor or motors other than the shuttle driving motor regarding which the loss of synchronism has been detected, until rotation of the main shaft stops. Accordingly, at least the shuttle driving motor or motors regarding which the loss of synchronism has not occurred are stopped in synchronism with the main shaft. Consequently, the sewing needles can be prevented from colliding against the respective shuttles in the emergency stop.

In a preferred form, the emergency stop control means instructs the sewing control means to rotate, in synchronism with the main shaft, at least the shuttle driving motor or motors other than the shuttle drive motor regarding which the loss of synchronism has been detected, when the main shaft is manually rotated after stop thereof in the abnormal condition. In another preferred form, the emergency stop control means instructs the sewing control means to stop the shuttle driving motor regarding which the loss of synchronism has been detected in the abnormal condition. In further another preferred form, the emergency stop control means instructs the sewing control means to stop the main shaft so that the main shaft is driven to assume a predetermined rotational position for start of the sewing when or after the main shaft has been stopped in the abnormal condition, and wherein the emergency stop control means instructs the sewing control means to rotate, in synchronism with the main shaft, at least the shuttle driving motor or motors other than the shuttle driving motor regarding which the loss of synchronism has been detected, when the main shaft is driven to assume the predetermined rotational position.

In further another preferred form, the emergency stop control means instructs the sewing control means to rotate, without synchronization with the main shaft, at least the shuttle driving motor or motors other than the shuttle driving motor regarding which the loss of synchronism has been detected, so that the motor or motors are rotated to assume a position or positions at which a needle thread loop or loops are disengaged from the shuttle or shuttles respectively, after the main shaft has been stopped in the abnormal condition. Furthermore, the emergency stop control means preferably instructs the sewing control means to rotate, in synchronism with the main shaft, at least the shuttle driving motor or motors other than the shuttle driving motor regarding which the loss of synchronism has been detected, when the main shaft is manually or mechanically rotated after stop thereof in the abnormal condition. In this control manner, the emergency stop control means preferably instructs the sewing control means to maintain in a stopped state the shuttle driving motor regarding which the loss of synchronism has been detected, when the main shaft is manually or mechanically rotated.

The invention also provides a multihead sewing machine comprising a sewing machine motor, a main shaft rotated by the sewing machine motor, a plurality of sewing needles driven by the main shaft, a plurality of shuttles for capturing thread loops in cooperation with the sewing needles respectively, each shuttle having a hook shaft, a plurality of shuttle driving motors for rotating the hook shafts of the shuttles independent of the sewing machine motor respectively, sewing control means for controlling the sewing machine motor and the shuttle driving motors so that the sewing machine motor and each shuttle driving motor are rotated in synchronism with each other, loss-of-synchronism detecting means for detecting loss of synchronism of each shuttle relative to the corresponding sewing needle, and emergency stop control means for instructing the sewing control means to rotate, in synchronism with the main shaft, at least the shuttle driving motor or motors other than the shuttle driving motor regarding which the loss of synchronism has been detected by the loss-of-synchronism detecting means, when the main shaft is stopped and subsequently rotated manually or mechanically in an abnormal condition wherein the loss of synchronism has been detected with respect to the shuttle driving motor.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

One embodiment will be described with reference to the accompanying drawings. The invention is applied to a multihead embroidery machine in the embodiment. The multihead embroidery machine comprises three sewing machine units, for example. In each sewing machine unit, a full-turn shuttle serving as a thread loop capturing shuttle is driven by a shuttle driving motor independent of a sewing machine motor.

Figure 1:
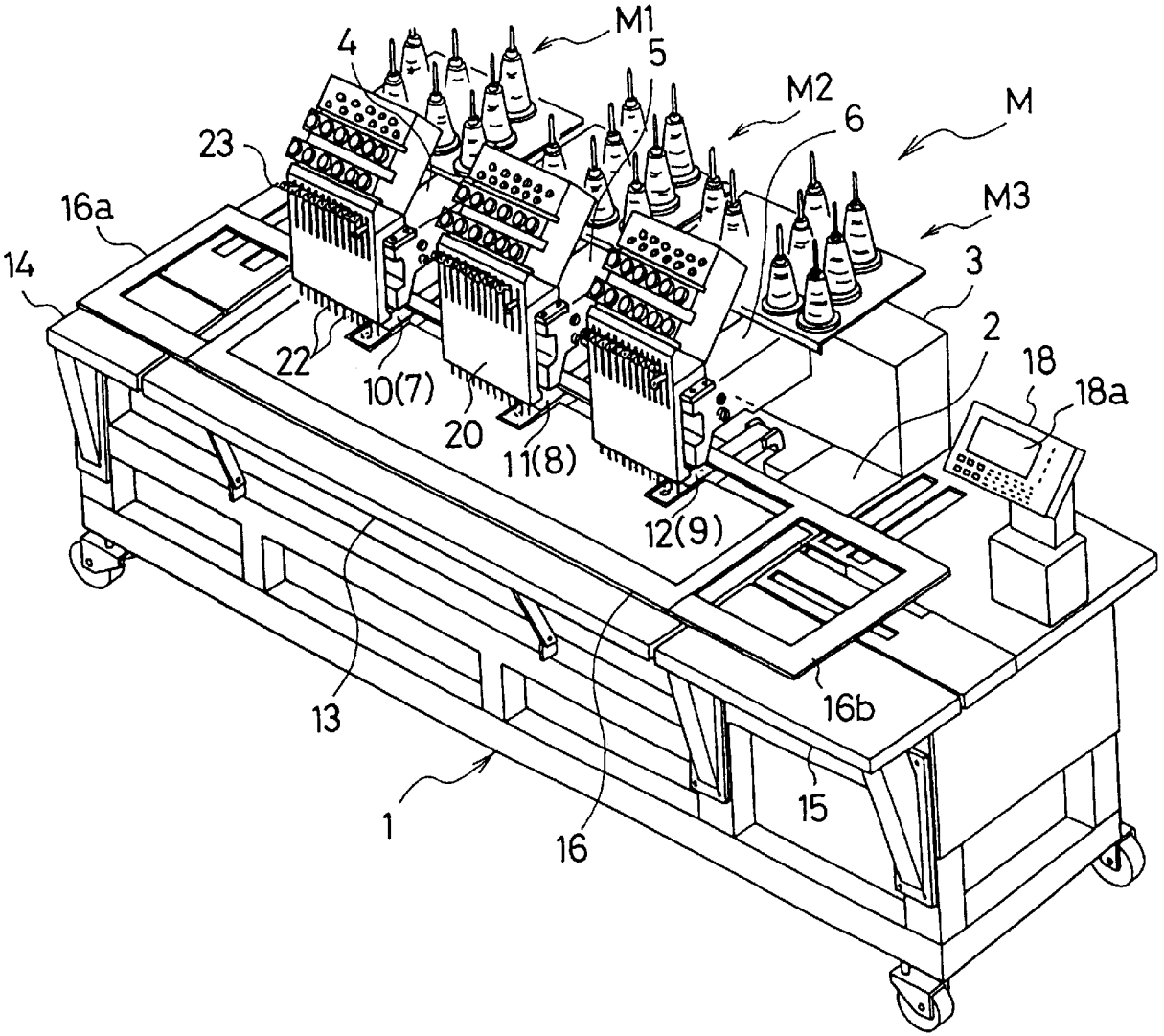
FIG. 1 is a perspective view of a multihead embroidery machine of one embodiment in accordance with the present invention.

The multihead embroidery machine M will first be described. The multihead embroidery machine M comprises an elongated base frame 1 extending laterally as viewed in FIG. 1. A generally rectangular machine support plate 2 is provided at an upper rear of the base frame 1. A laterally extending support frame 3 stands from a rear end of the machine support plate 2. Three heads 4 to 6 are disposed on the support frame 3 at predetermined intervals. Three generally cylindrical sewing beds 7 to 9 have rear ends mounted on a portion of the base frame 1 located at a front end of the machine support plate 2 so as to correspond to the heads 4 to 6, respectively. The sewing beds 7 to 9 constitute independent bed units 10 to 12 respectively.

The heads 4 to 6 disposed on the support frame 3 and the independent bed units 10 to 12 constitute three multineedle embroidery machine units M1, M2 and M3 respectively. The multineedle sewing machine units M1 to M3 are disposed on the base frame 1 to be arranged along the length thereof. Three needle bar cases 20 are provided on front ends of the heads 4 to 6 to be movable in a transverse direction or rightward and leftward, respectively. In each needle bar case 20, twelve needle bars 21 (see FIG. 2) are vertically movably mounted and twelve thread take-up levers 23 are rockably mounted. The needle bars 21 are arranged in the transverse direction and have lower ends to which sewing needles 22 are attached respectively. The needle bar cases 20 are linked to one another so as to be moved rightward and leftward by a needle bar changing mechanism (not shown) driven by a needle bar changing motor 115 (see FIG. 8). Consequently, embroidery threads of one color can simultaneously be changed to those of another color in the three embroidery machine units M1 to M3.

A working table 13 is horizontally provided in front of the machine support plate 2 so as to be substantially planar with the upper faces of the bed units 10 to 12. A pair of auxiliary tables 14 and 15 are provided at the left-hand and right-hand sides of the working table 13 respectively. An elongated rectangular moving frame 16 is disposed to extend over the working and auxiliary tables 13, 14 and 15 and to be moved in directions of X-axis and Y-axis. The moving frame 16 includes a left-hand end drive frame portion 16*a* moved in the directions of X-axis or leftward and rightward by an X-axis drive mechanism (not shown) and a right-hand end drive frame portion 16*b* moved in the directions of Y-axis or forward and backward by a Y-axis drive mechanism (not shown) together with the frame portion 16*a*. The moving frame 16 is thus moved by the X-axis and Y-axis drive mechanisms in the directions of X-axis and Y-axis or on an X-Y plane. The X-axis and Y-axis drive mechanisms are driven by X-axis and Y-axis drive motors 117 and 119 (see FIG. 8) respectively. An operation panel 18 is provided in the rear of the auxiliary table 15. The operation panel 18 includes a display 18*a* for displaying messages concerning the embroidery sewing etc. and various operation switches.

Figure 2:
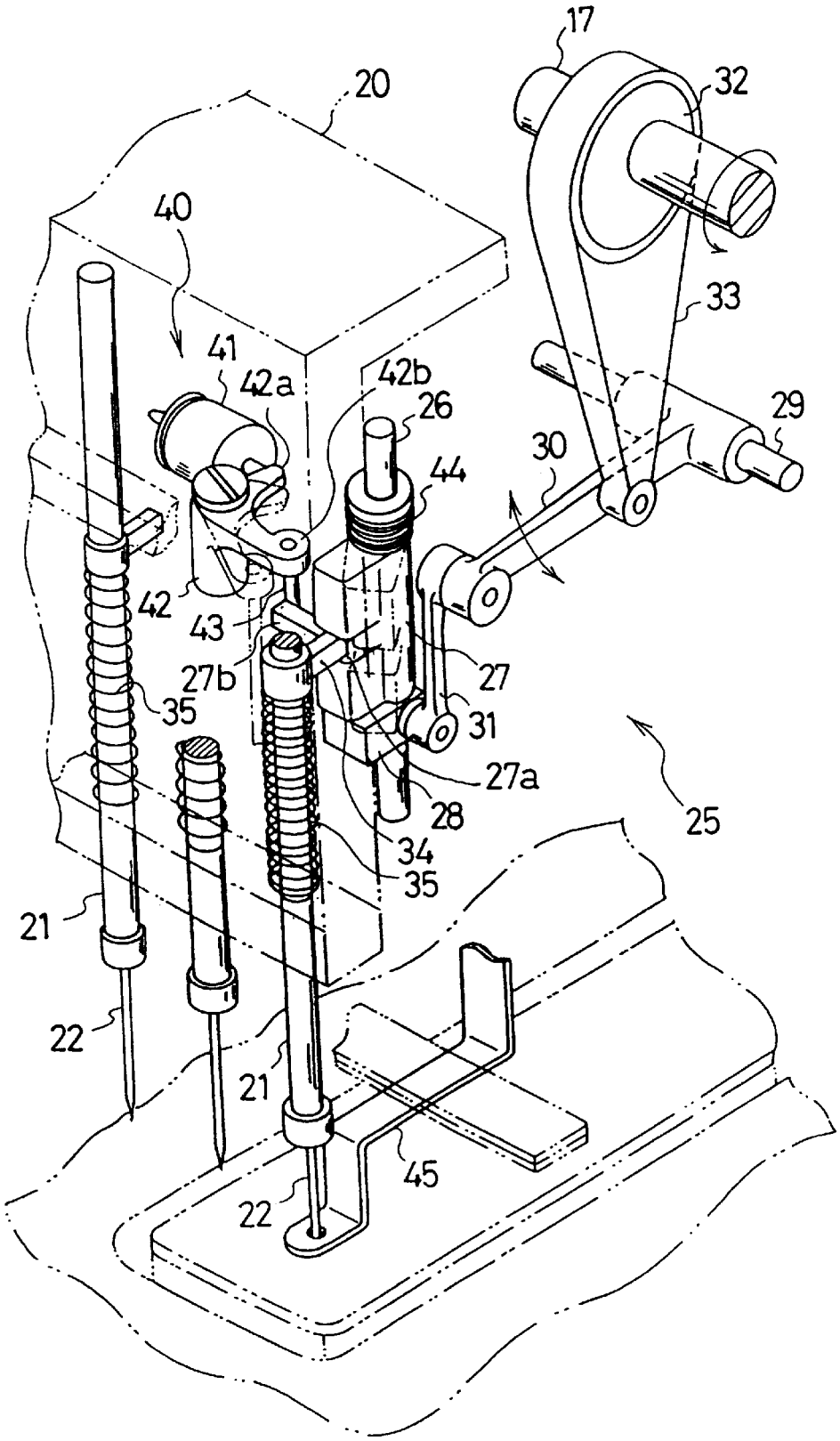
FIG. 2 is a schematic perspective view of a needle bar vertically moving mechanism including a needle bar jumping mechanism.

Each of the embroidery machine units M1 to M3 is provided with a needle bar vertically moving mechanism 25 for vertically moving the needle bars 21 as shown in FIG. 2. Three vertically extending needle bar bases 26 are provided at distal ends of the heads 4 to 6 respectively. Upper and lower ends of each needle bar base 26 are supported on the frame. A vertically moving member 27 is fitted with each needle bar base 26 for vertical movement and rotation. Each vertically moving member 27 has an engagement groove 27*a* with which a connecting pin 34 is engaged as will be described later. A needle bar jamb 28 is fitted with the needle bar base 26 to be vertically movable and non-rotatable and further connected to the lower end of the vertically moving member 27 for rotation. Each needle bar jamb 28 is connected via a link 31 to a rocking lever 30 rockably mounted on a pivot shaft 29. A main shaft 17 extends through the heads 4 to 6 along the elongation of the base frame 1. Three eccentric cams 32 are secured to the main shaft 17. An eccentric lever 33 is fitted with each eccentric cam 32. Each eccentric lever 33 has a lower end connected to the rocking lever 30. The main shaft 17 is rotated via a belt transmission mechanism (not shown) by a sewing machine motor 110. A rotary encoder 112 is provided for detecting a rotational angle of the main shaft 17.

Sewing needles 22 are attached to the lower ends of the needle bars 21 respectively. The connecting pins 34 are secured to vertically middle portions of the needle bars 21 respectively. A compression coil spring 35 is provided about each needle bar 21 to be located between the connecting pin 34 and the support frame for the needle bar case 20. Each needle bar 21 is urged by the spring 35 upwardly or toward a raised position. The connecting pin 34 of the needle bar 21 opposed to the vertically moving member 27 is selectively engaged with the engagement groove 27*a* when each needle bar case 20 is moved rightward and leftward. When the main shaft 17 is rotated by the sewing machine motor 110 rotated in a predetermined direction, the rotation of the main shaft 17 is converted to vertical motion by the eccentric cams 32, the eccentric levers 33, the rocking levers 30, the links 31, the vertically moving members 27 and the needle bar jambs 28, so that the vertically moving members 27 and the needle bar jambs 28 are vertically moved together. Consequently, only one of the twelve needle bars 21 connected via the connecting pin 34 to the vertically moving member 27 is reciprocally moved vertically in synchronism with the main shaft 17.

Each of the embroidery machine units M1 to M3 is provided with a needle bar jumping mechanism 40 for jumping the needle bar 21 up to its uppermost position (top dead point). Referring to FIG. 2, a horizontal needle bar jumping solenoid 41 is provided in each needle bar case 20. A generally L-shaped rotatable lever 42 is mounted on each needle bar case 20 to be rotatable about a vertical axis. Each rotatable lever 42 includes a driving portion 42*a* abutted against a plunger of the solenoid 41. Each rotatable lever 42 further includes a driven portion 42*b* on which a vertically extending operation shaft 43 is mounted. Each operation shaft 43 is engageable with a protruding engagement portion 27*b* formed integrally with each vertically moving member 27. Each vertically moving member 27 is urged by a coil spring 44 mounted on the upper end thereof to be rotatively moved from a jump position shown by two-dot chain line to a normal connection position shown by solid line in FIG. 2.

Each solenoid 41 is driven for a predetermined period of time to move the plunger rightward when the needle bar 21 is connected via the connecting pin 34 to the vertically moving member 27. Consequently, each rotatable lever 42 is rotatively moved clockwise such that each operation shaft 43 pushes the engagement portion 27*b*, whereupon each vertically moving member 27 is rotatively moved to the jump position shown by the two-dot chain line in FIG. 2. Thus, the connecting pin 34 is disengaged from the engagement groove 27*a* and simultaneously, the compression coil spring 35 causes the needle bar 21 to move or jump to the raised position at a stroke.

Each vertically moving member 27 is abutted against the connecting pin 34 from below to be rotatively moved, thereby temporarily assuming the jump position, in the case where each member 27 is raised from a lower position almost to its uppermost position when the needle bar 21 assumes the raised position and each member 27 assumes the connecting position. Each vertically moving member 27 is immediately returned to the connecting position by the coil spring 44. Thus, each connecting pin 34 is automatically engaged with the engagement groove 27*a* of the vertically moving member 27.

A presser foot 45 is provided over each of the sewing beds 7 to 9 to be movable between a pressing position where the presser foot presses a workpiece cloth W on each sewing bed and a retreat position which is upwardly spaced away from the pressing position by a predetermined distance. Each presser foot 45 is moved between and held at the pressing and retreat positions by a presser foot driving mechanism (not shown) driven by a presser foot driving solenoid 106 (see FIG. 8).

The bed units 10 to 12 will now be described with reference to FIGS. 3 to 6. Since the three bed units 10 to 12 have the same construction, the only left-hand end bed unit 10 will be described. The bed unit 10 includes a bed case 50 having a generally U-shaped section and extending widthwise with respect to the base frame 1. A rear end of the bed case 50 is mounted to a pair of support brackets 51 secured to the base frame 1 and located at the front end of the machine support plate 2. A shuttle module 55 is detachably attached to a front end of the bed case 50. A forward top of the bed case 50 is covered with a throat plate 52. The other portion of the bed case 50 is covered with a cover plate 53 extending rearward continuously from the throat plate 52.

Figure 4:
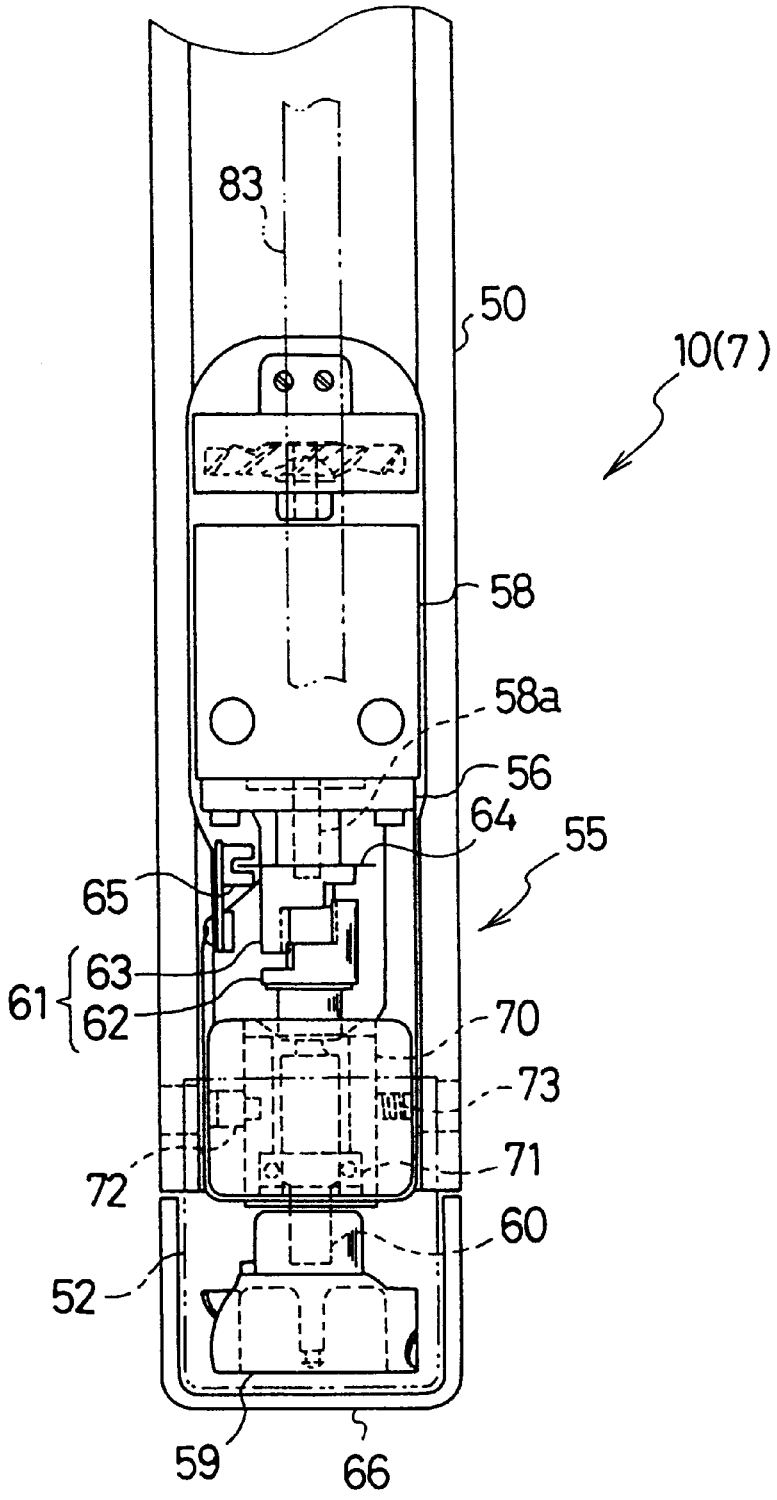
FIG. 4 is a partial plan view of the bed unit provided with a shuttle module.
Figure 5:
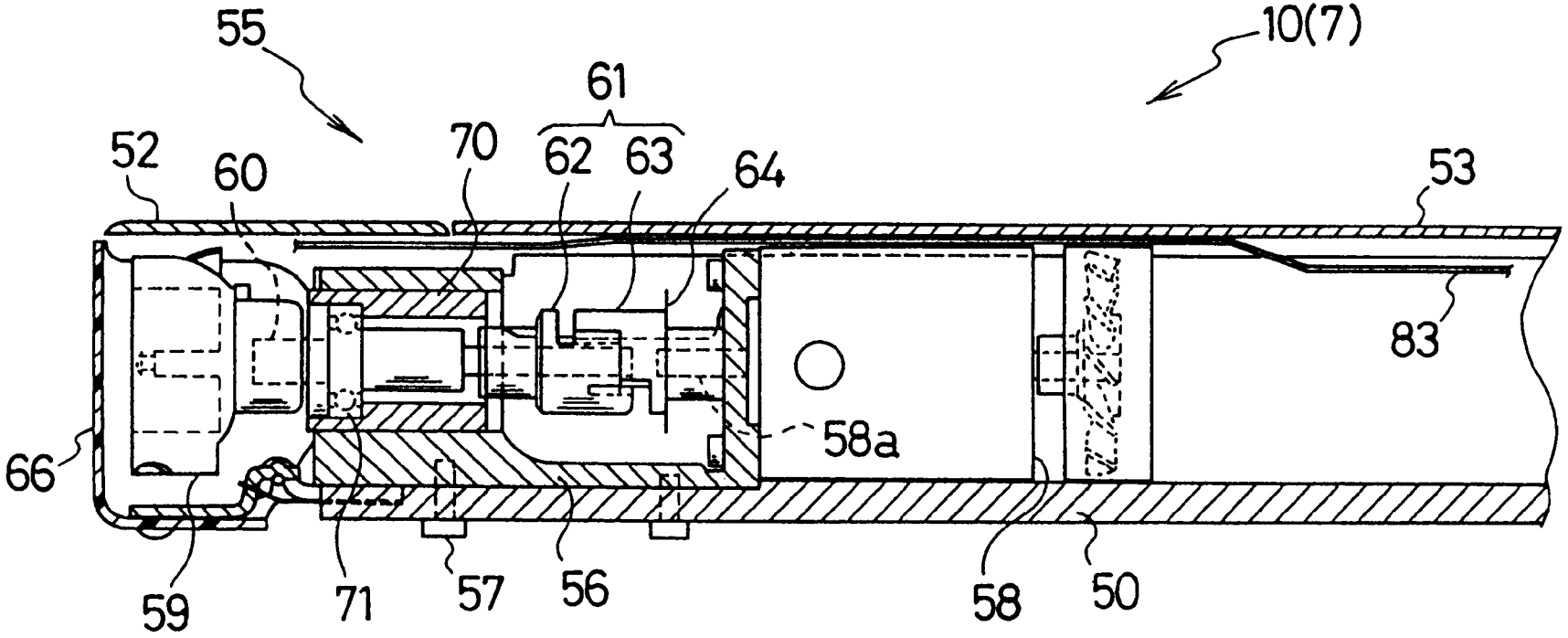
FIG. 5 is a partial longitudinal section of the bed unit provided with the shuttle module.

The shuttle module 55 will then be described. Referring to FIGS. 4 and 5, a mounting block 56 is detachably mounted by small screws 57 on the front end of the bed case 50. A shuttle driving motor 58 comprising, for example, a pulse motor is provided in the rear of the mounting block 56. For example, a full-turn shuttle 59 for capturing a thread loop is provided in front of the mounting block 56. A hook shaft 60 secured to the shuttle 59 is mounted on the mounting block 56 for rotation and for forward and rearward positional adjustment. A first connecting member 62 is mounted to a rear end of the hook shaft 60. A second connecting member 63 is mounted to a forward end of a rotational shaft 58*a* of the shuttle driving motor 58. The first and second connecting members 62 and 63 are connected to each other. More specifically, the hook shaft 60 and the drive shaft 58*a* are connected together via a coupling 61 comprising the two connecting members 62 and 63. Upon drive of the shuttle driving motor 58, the hook shaft 60 is rotated via the drive shaft 58*a* and the coupling 61 so that the hook shaft 60 is rotated.

The full-turn shuttle 59 comprises a rotating hook bobbin case holder 59*a*, and a rotating hook 59*b* rotated around the holder 59*a*. The bobbin case holder 59*a* is adapted to hold a bobbin case 67 for accommodating a bobbin. The rotating hook 59*b* has a beak 59*c* for seizing a needle thread 47 to form a needle thread loop 47*a*. A timing for encounter of the beak 59*c* with an eye of the needle 22 is reached when the main shaft 17 assumes an about 200-degree position, so that the needle thread 47 extending through the eye of the needle 22 is caught by the beak 59*c*. A further rotation of the rotating hook 59*b* forms a needle thread loop 47*a* moved between the bobbin case holder 59*a* and the rotating hook 59*b*.

Referring to FIG. 4, a rotary encoder 65 is provided in the vicinity of the second connecting member 63. The rotary encoder 65 comprises a disk 64 mounted on the second connecting member 63 and a photointerrupter 65*a* mounted on the mounting block 56. The photointerrupter 65*a* is designed to optically detect a plurality of slits formed in the disk 64, thereby delivering hook shaft rotation signals. A rotational speed K at which the full-turn shuttle 59 is rotated in a predetermined direction by the shuttle driving motor 58 is set to be twice as high as the rotational speed of the main shaft 17. A front end opening of the bed unit 10 is covered with a protective cover 66 pivoted to be opened and closed on a hinge mounted on the front end of the bed case 50. The full-turn shuttle 59 is covered by the protective cover 66.

A support structure for supporting the full-turn shuttle 59 will now be described in brief. A cylindrical bearing case 70 is provided directly inside the cylindrical portion of the mounting block 56 so as to be slidable forward and backward. A bearing 71 is provided in the bearing case 70 by press fitting. An eccentric pin 72 is mounted on a left-hand side wall of the mounting block 56. A distal end pin portion of the eccentric pin 72 is engaged with a longitudinal pin hole formed in a left-hand side wall of the bearing case 70. A setting screw 73 is detachably mounted on a right-hand side wall of the mounting block 56 for fixing the bearing case 70. The eccentric pin 72 is turned clockwise or counterclockwise while the setting screw 73 being loosened, whereby the bearing case 70 can be moved forward and backward by a slight distance, for example, 1 or 2 mm. Consequently, the position of the shuttle 59 can be adjusted forward and backward for adjustment of a needle gap.

Figure 3:
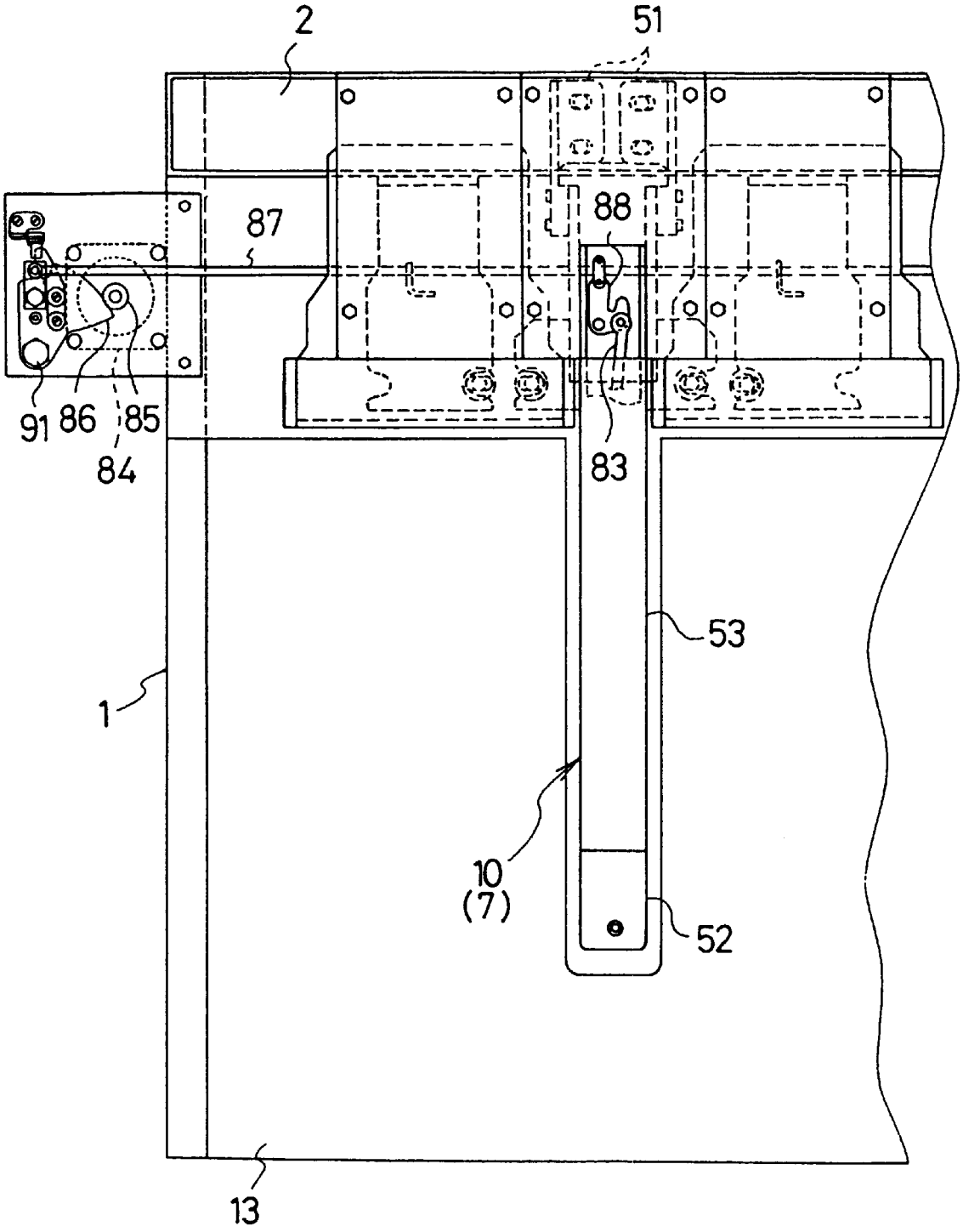
FIG. 3 is a partial plan view showing a working table and one of a plurality of bed units of the multihead sewing machine.
Figure 6:
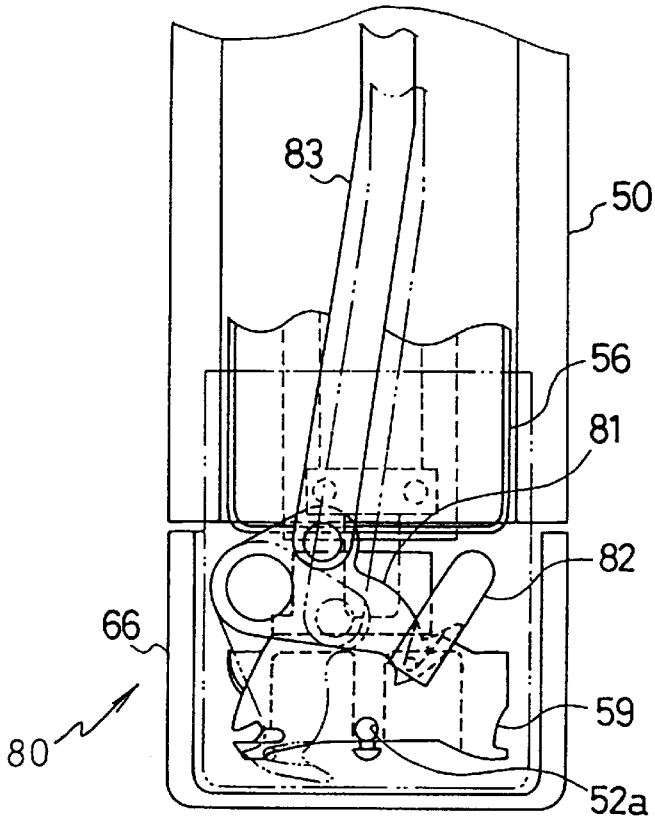
FIG. 6 is a partially enlarged plan view of a distal end of the bed unit.
Figure 7:
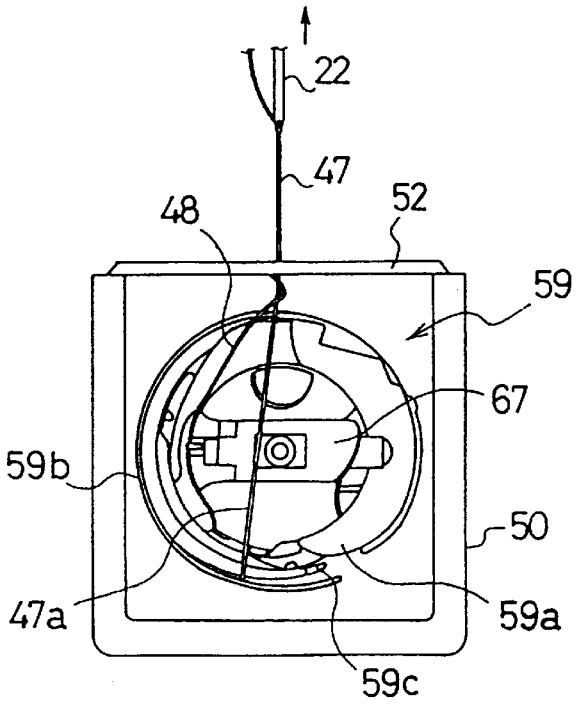
FIG. 7 is a front view of a full-turn shuttle when a main shaft assumes an about 300-degree position.

Each of the bed units 10 to 12 is provided with a thread cutting mechanism 80 for cutting the needle thread 47 and the bobbin thread 48. Referring to FIGS. 3 and 6, a movable blade 81 is pivotally mounted on the underside of the throat plate 52. The blade 81 is rockable between a standby position shown by solid line and a rotatively moved position shown by two-dot chain line in FIG. 6. A fixed blade 82 is mounted on the underside of the throat plate 52 to be opposed to an upper portion of the movable blade 81. The fixed blade 82 cuts the needle thread 47 and the bobbin thread 48 in cooperation with the movable blade 81. A thread cutting operation lever 83 rearwardly extends through the interior of the bed case 50. A thread cutting motor 84 is provided at the left-hand end of the base frame 1 as shown in FIG. 3. Upon drive of the thread cutting motor 85, a sectorial rocking member 86 brought into mesh engagement with a driving gear 85 rocks to thereby move a thread cutting operation shaft 87 rightward and leftward, and a rotary plate 88 moves the thread cutting operation lever 83 forward and backward. Consequently, the movable blade 81 is rotated to simultaneously cut the needle thread 47 and the bobbin thread 48 in cooperation with the fixed blade 82.

Figure 8:
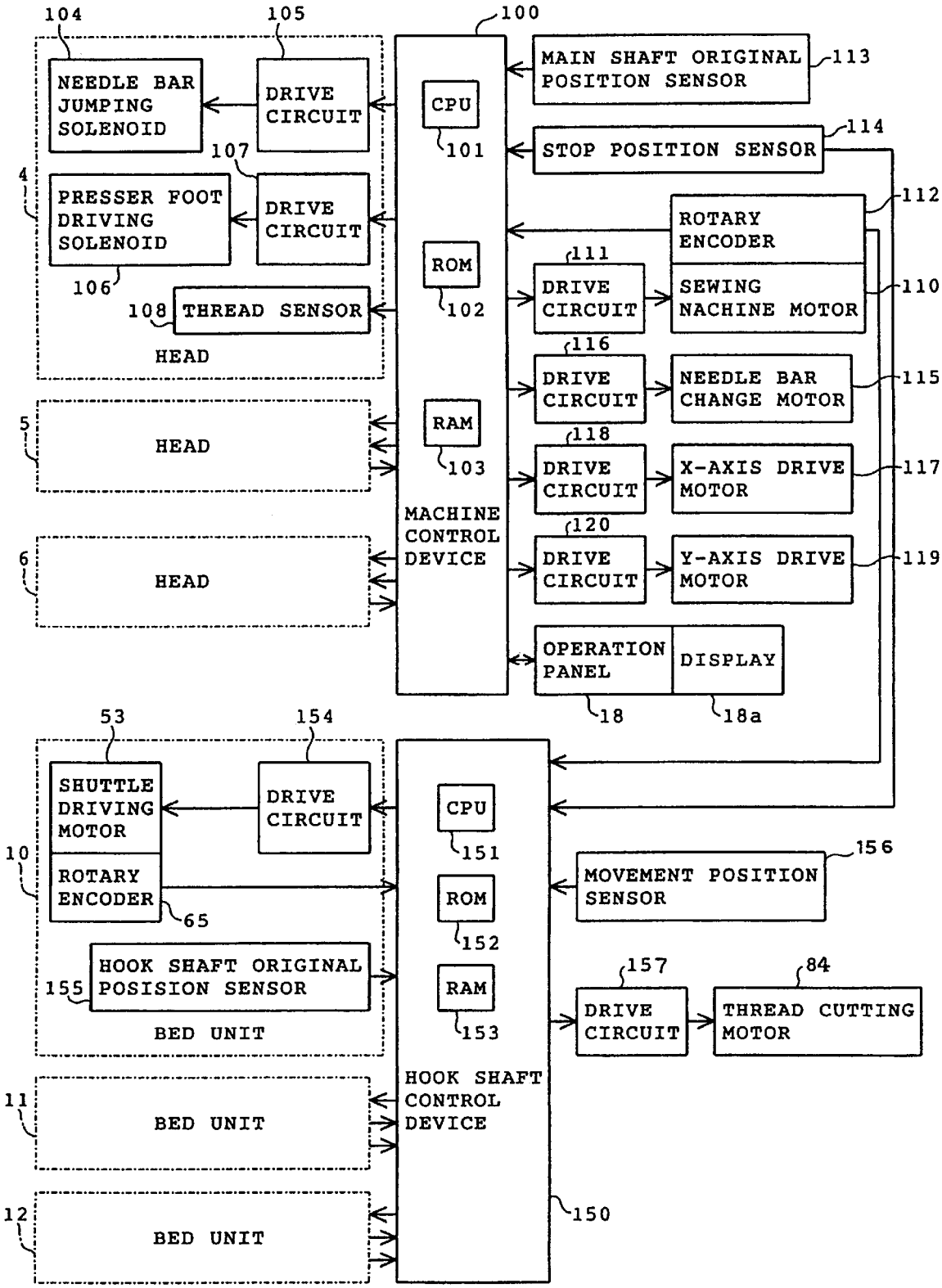
FIG. 8 is a block diagram showing a control system of the multihead embroidery machine.

An electrical arrangement or control system of the multihead embroidery machine M will now be described with reference to FIG. 8. A machine control device 100 has a function of controlling an overall operation of the machine M except for control for the shuttle drive. The machine control device 100 comprises a microcomputer composed of a CPU 101, a ROM 102 and a RAM 103, and an input interface (not shown) and an output interface (not shown) each connected via data buses to the microcomputer. The ROM 102 stores sewing data corresponding to a plurality of embroidery patterns and a control program for controlling the sewing on the basis of the selected sewing data in a manner as will be described later.

With respect to each of the heads 4 to 6, the machine control device 100 is connected to a drive circuit 105 for driving a solenoid 104 of the needle bar jumping mechanism. The machine control device 100 is also connected to a drive circuit 107 for driving a presser foot driving solenoid 106. The machine control device 100 is further connected to a thread sensor 108 for detecting presence or absence of a thread. Furthermore, the machine control device 100 is connected to a drive circuit 111 for driving the machine motor 110, a drive circuit 116 for driving a needle bar change motor 115 moving the needle bar case 20, a drive circuit 118 for driving an X-axis drive motor 117, a drive circuit 120 for driving a Y-axis drive motor 119, and the operation panel 18. Additionally, the machine control device 100 is connected to the rotary encoder 112 different from the rotary encoder 65, a main shaft original position sensor 113, and a stop position sensor 114. The rotary encoder 112 comprises a disk mounted on the main shaft 17 and a photointerrupter neither of which are shown. The photointerrupter of the rotary encoder 112 optically detects a plurality of slits formed in the disk, thereby delivering, for example, one thousand slit signals (main shaft rotation signals) when the disk is rotated one turn. Based on the signals from the rotary encoder 112, the machine control device 100 detects a rotational position (rotational angle) of the main shaft 17. Alternatively, the rotational angle of a rotational shaft of the machine motor 110 may be detected by the rotary encoder 112. The main shaft original position sensor 113 delivers a main shaft original position signal when the main shaft 17 assumes a position corresponding to its original position or initial position every time of one turn of the disk. The stop position sensor 114 detects a stop position of the needle bar 21 corresponding to an about 100-degree position of the main shaft 17 when it is located over the needle.

A hook shaft control device 150 is connected to the machine control device 100. The hook shaft control device 150 has functions of controlling drive of the full-turn shuttles 59 and the thread cutting. The hook shaft control device 150 comprises a microcomputer composed of a CPU 151, a ROM 152 and a RAM 153, and an input interface (not shown) and an output interface (not shown) each connected via data buses to the microcomputer. The ROM 152 stores a control program for controlling the shuttle driving motors 58 etc. for execution of the sewing. With respect to the bed unit 10, the hook shaft control device 150 is connected to a drive circuit 154 for driving the shuttle driving motor 58, the rotary encoder 65, and a hook shaft original position sensor 155. The hook shaft original position sensor 155 delivers one hook shaft original position signal every time the disk 64 of the rotary encoder 65 is turned one turn. The photointerrupter 65*a* of the rotary encoder 65 delivers, for example, fifty slit signals every time the disk 64 is rotated one turn. The same circuits and sensor are connected to the hook shaft control device 150 with respect to each of the other bed units 11 and 12. Additionally, the hook shaft control device 150 is connected to a movement position sensor 156 for detecting a movement position of the movable blade 81 and a drive circuit 157 for driving the thread cutting motor 88.

The machine control device 100 and the hook shaft control device 150 constitute sewing control means in the invention. The sewing machine motor 110 comprises an induction motor and is controlled in a variable speed manner (inverter control) by the machine control device 100. The thousand main shaft rotation signals (slit signals) delivered by the rotary encoder 112 during one turn of the disk mounted on the main shaft 17 are subdivided into four thousand pulses used as main shaft control pulses to control the machine motor 110 etc. Each shuttle driving motor 58 comprises a stepping motor rotated one turn in response to, for example, five hundred pulses to thereby rotate the full-turn shuttle 59 one turn. Each shuttle driving motor 58 is controlled to be rotated two turns during one turn of the main shaft 17. Thus, each shuttle driving motor 58 is driven at the rotational speed twice as large as that of the main shaft 17 or the hook shaft rotational speed K as described above.

Figure 14:
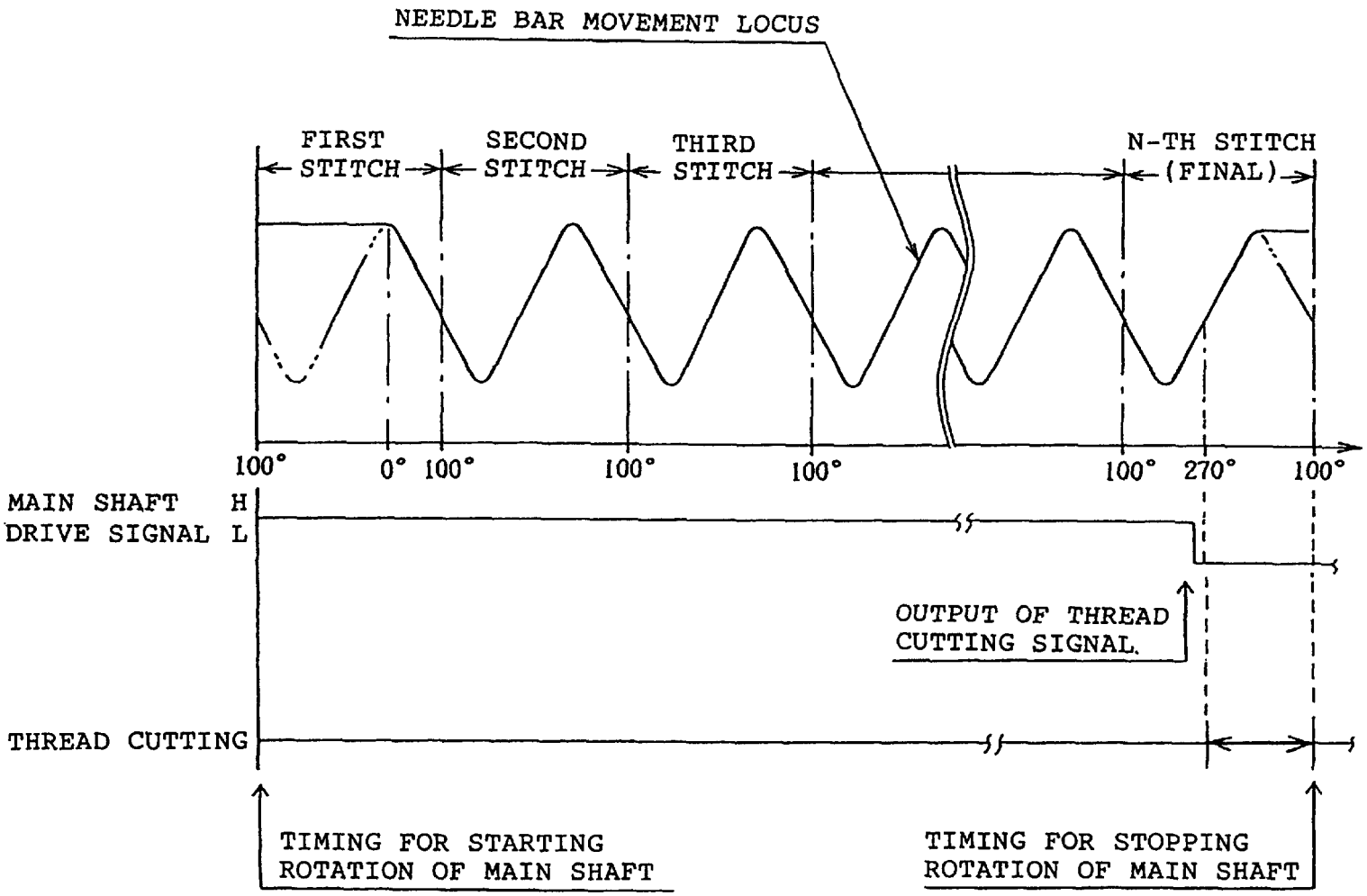
FIG. 14 is a time chart showing various signals delivered regarding the sewing executed on the basis of sewing data representative of the number of stitches shown by N.
Figure 15:
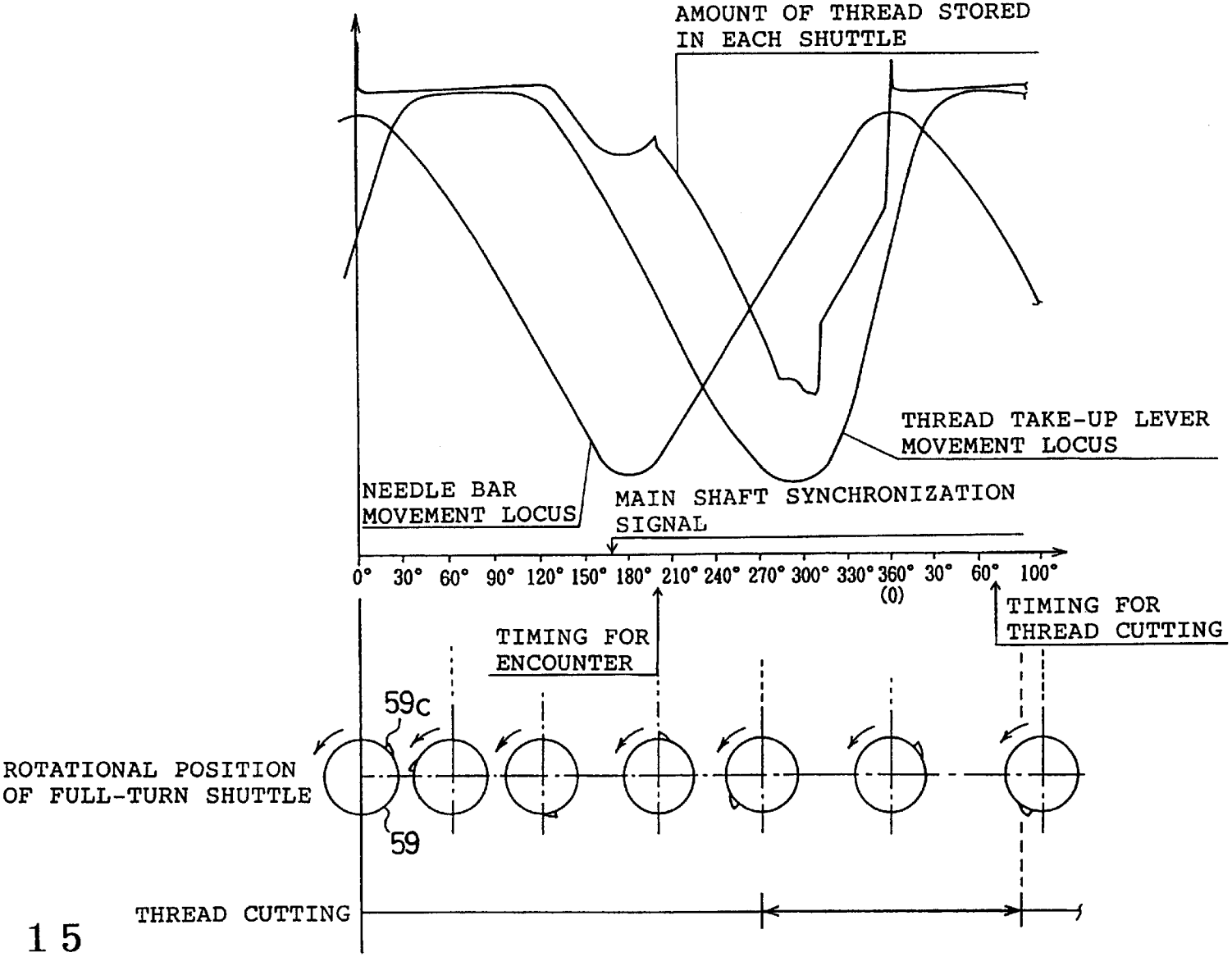
FIG. 15 is a graphical representation of movement curves of needle bar and thread take-up lever and a curve of amount of shuttle thread together with rotational positions of the full-turn shuttle corresponding to the rotational positions of the main shaft.

The contents of sewing control executed by the hook shaft control device 150 will now be described with reference to FIGS. 9 to 13. First, the drive signals for the sewing control and the timing of generation of these signals will be described with reference to FIGS. 14 and 15. The main shaft 17 normally remains stopped at an about 100-degree rotational position when the sewing is started, as shown in FIGS. 14 and 15. Each needle bar 21 is held at the uppermost position by the corresponding needle bar jumping mechanism 40. Assume now that an embroidery is sewn on the basis of embroidery data containing data of needle location for the number N of stitches. In this case, the main shaft drive signal from the machine control device 100 is switched to the high level (H) and simultaneously, drive of the machine motor 110 is started. The above-mentioned embroidery data does not include thread cutting data for a thread exchange. The embroidering corresponding to the number N of stitches is sequentially executed, and the thread cutting is executed at the final N-th stitch.

Each needle bar 21 is automatically connected to the corresponding vertically moving member 27 at a first stitch when the main shaft 17 assumes the zero-degree position or the needle bar is located at the uppermost position. Accordingly, stitches are formed from a second stitch and on when the needle thread 47 is not drawn (picker) at the start of the sewing. The main shaft drive signal is switched to the low level (L) when the main shaft assumes an about 260-degree position at the final N-th stitch. Simultaneously, the thread cutting signal is delivered and subsequently, the thread cutting is executed when the main shaft 17 assumes the positions ranging between the 270-degree position and 448-degree (88-degree) position. Thereafter, the rotation of the main shaft 17 is stopped when it assumes the 460-degree (100-degree) position.

Figure 9:
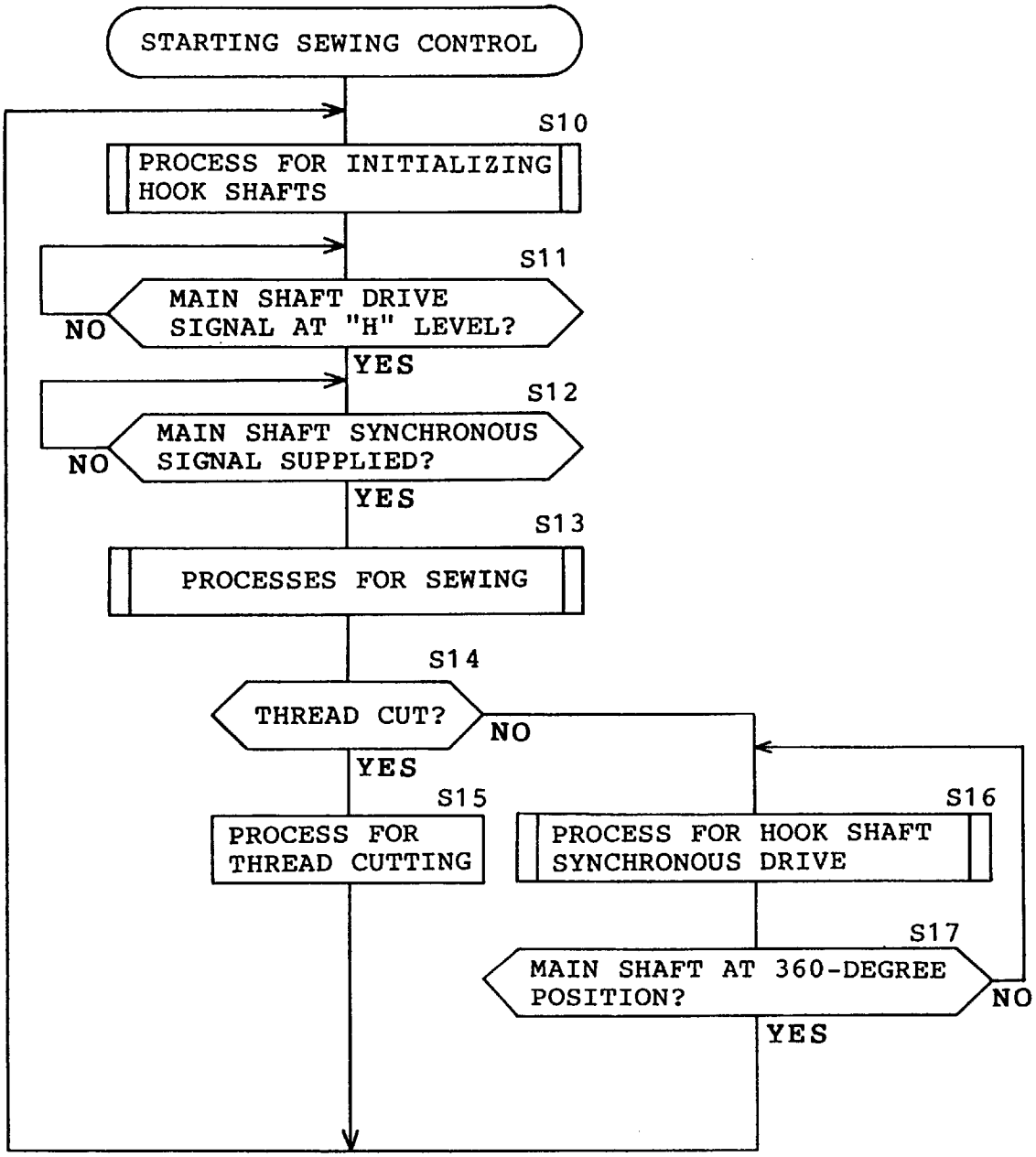
FIG. 9 is a schematic flowchart explaining a sewing control routine.
Figure 10:
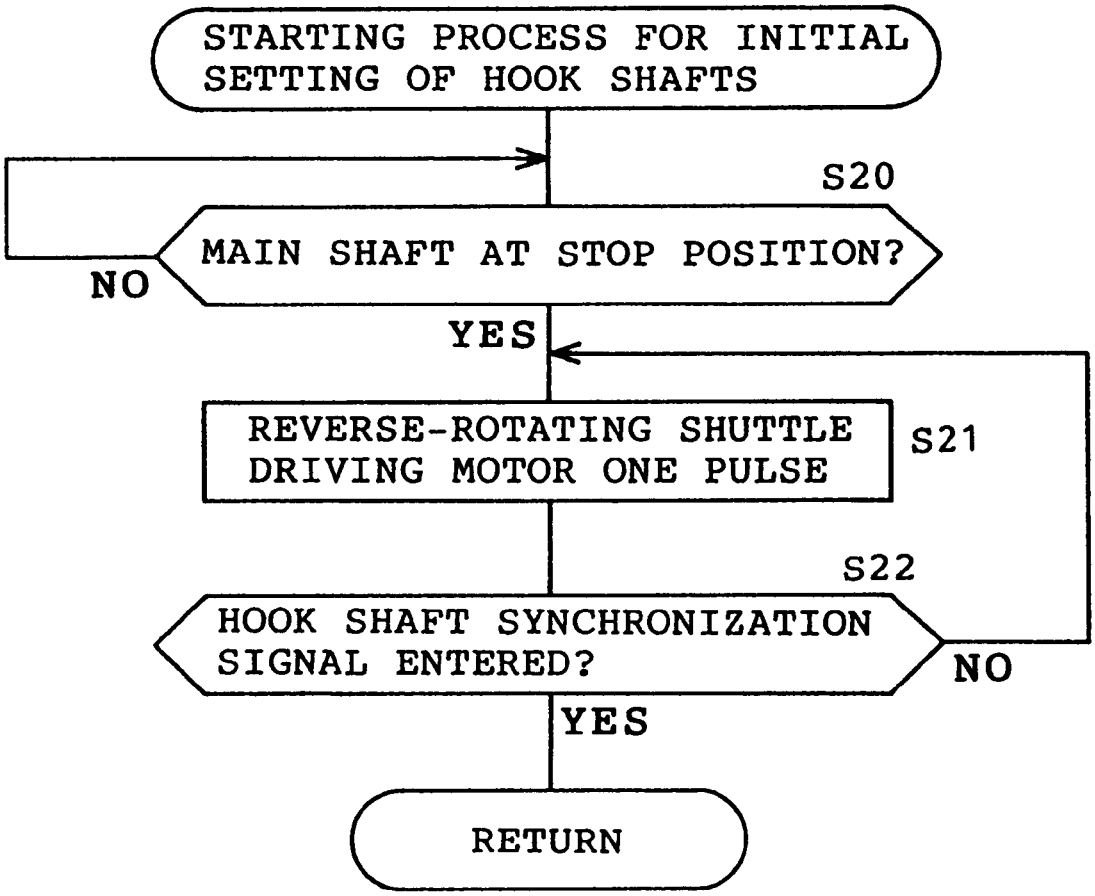
FIG. 10 is a schematic flowchart explaining a routine of main shaft and hook shaft initializing processes.
Figure 11:
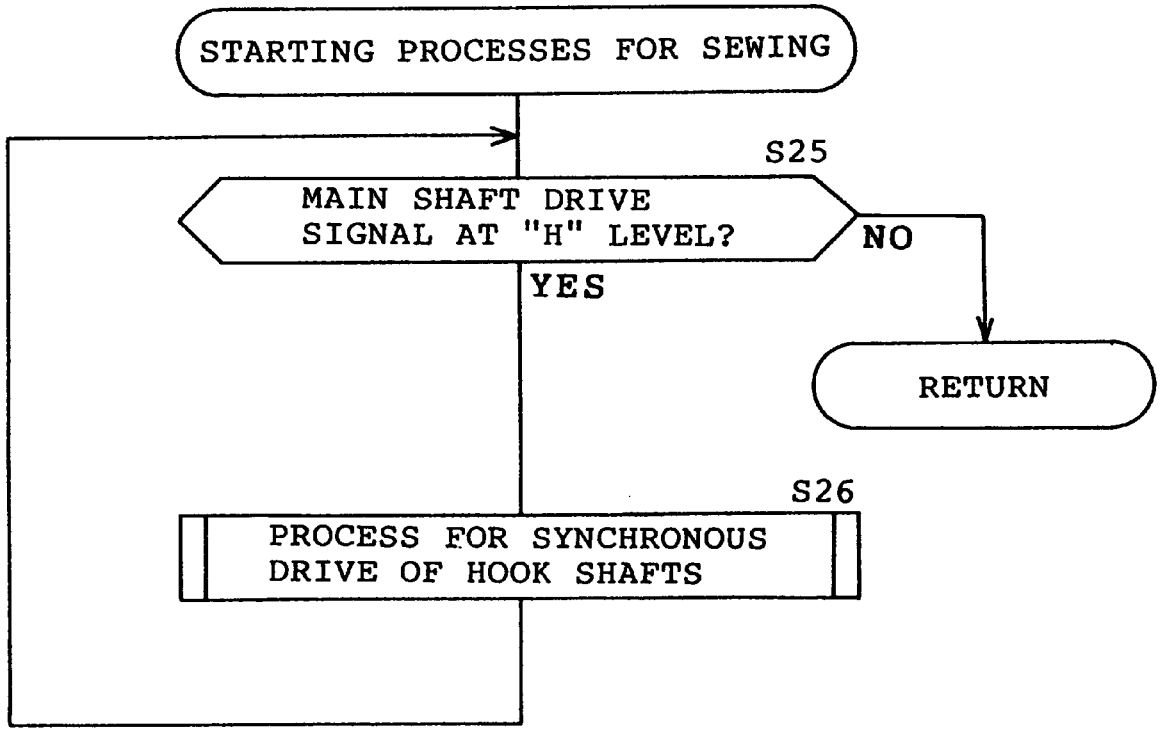
FIG. 11 is a schematic flowchart explaining a routine of sewing process.

Upon operation of the sewing start switch on the operation panel 18, the sewing control as shown in FIG. 9 is started and a process for initializing the hook shaft (see FIG. 10) is executed at step S10. Upon start of the hook shaft initializing process, the stop position signal delivered by the stop position sensor 114 is entered so that a judgment is made as to whether the main shaft 17 assumes the stop position or the initially set 100-degree position where the previous sewing process was completed and the thread was cut (step S20). An affirmative judgment is made (YES at step S20) when the main shaft 17 is located at the stop position. Since the hook shaft 60 then assumes the rotational position corresponding to an about 13-degree (193-degree) position of the main shaft 17, one pulse is supplied to the shuttle driving motor 58 so that the motor is reverse-rotated in order that the hook shaft 60 is returned to the rotational position where the hook shaft original position sensor 155 delivers the hook shaft synchronization signal (step S21). A judgment is then made at step S22 as to whether the hook shaft synchronization signal has been delivered by the hook shaft original position sensor 155. A negative judgment is made (NO at step S22) when the hook shaft synchronization signal has not been delivered, and the steps S21 and S22 are repeatedly executed. The hook shaft synchronization signal is delivered at step S22 when the hook shaft 60 has been moved to assume the initially set position corresponding to the initially set 180-degree position of the main shaft 17. The control is then completed, and the control sequence returns to step S11 for the hook shaft drive control. Upon delivery of the hook shaft synchronization signal, the hook shaft control device 150 delivers a READY signal to the machine control device 100, whereupon the control for the main shaft 17 or machine motor 110 side is started.

On the other hand, when the main shaft 17 is not located at the stop position (NO at step S20), the hook shaft control device 150 delivers to the machine control device 100 a signal indicating that the main shaft 17 is not located at the stop position, although this is not shown in the drawings. Then, the machine control device 100 controls the display 18*a* of the operation panel 18 so that an error message indicating that the main shaft 17 is not located at the stop position is displayed. The operator manually turns a manually operated pulley provided at one end of the main shaft 17 so that the main shaft is rotated to assume the predetermined stop position.

Subsequently, a judgment is made at step S11 as to whether the high (H) level main shaft drive signal has been delivered by the machine control device 100 or whether the sewing has been started. When the sewing has not been started (NO at step S11), the control is on standby at step S11 until the sewing is started. When the high (H) level main shaft drive signal has been delivered by the machine control device 100 upon start of the sewing (YES at step S11), the sewing machine motor 110 is simultaneously rotated so that the main shaft 17 is driven from the 100-degree position. Furthermore, when the main shaft 17 is rotated to assume an about 170-degrees position at a first stitch subsequent to the start of the sewing so that the main shaft original position sensor 113 delivers the main shaft synchronization signal. Upon delivery of the main shaft synchronization signal (YES at step S12), each shuttle driving motor 58 of each of the corresponding bed units 10 to 12 is driven in synchronism with the main shaft 17 so that the sewing process (see FIG. 11) is executed at step S13.

Upon start of the sewing process, a judgment is made at step S25 as to whether the main shaft drive signal from the machine control device 100 is at the high (H) level or whether the sewing is being executed. When the main shaft drive signal is at the high (H) level (YES at step S25), the process for hook shaft synchronous drive (see FIG. 12) is repeatedly executed at step S26 so that an embroidery is formed stitch by stitch until the sewing operation is performed from the first to the N-th stitch or the main shaft drive signal is turned to the low (L) level such that the sewing process is completed.

Figure 12:
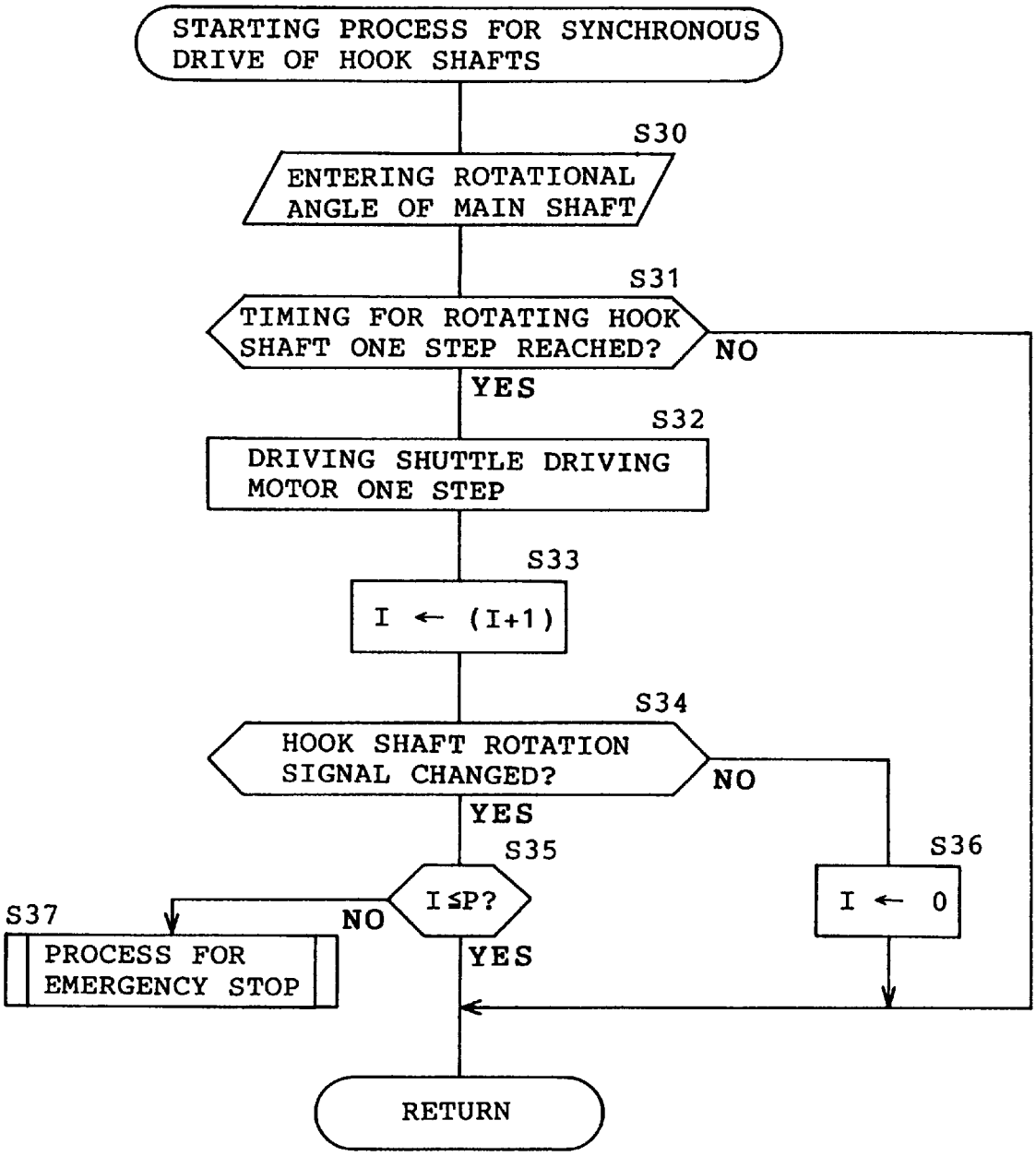
FIG. 12 is a schematic flowchart explaining a routine of hook shaft synchronous drive process.
Figure 13:
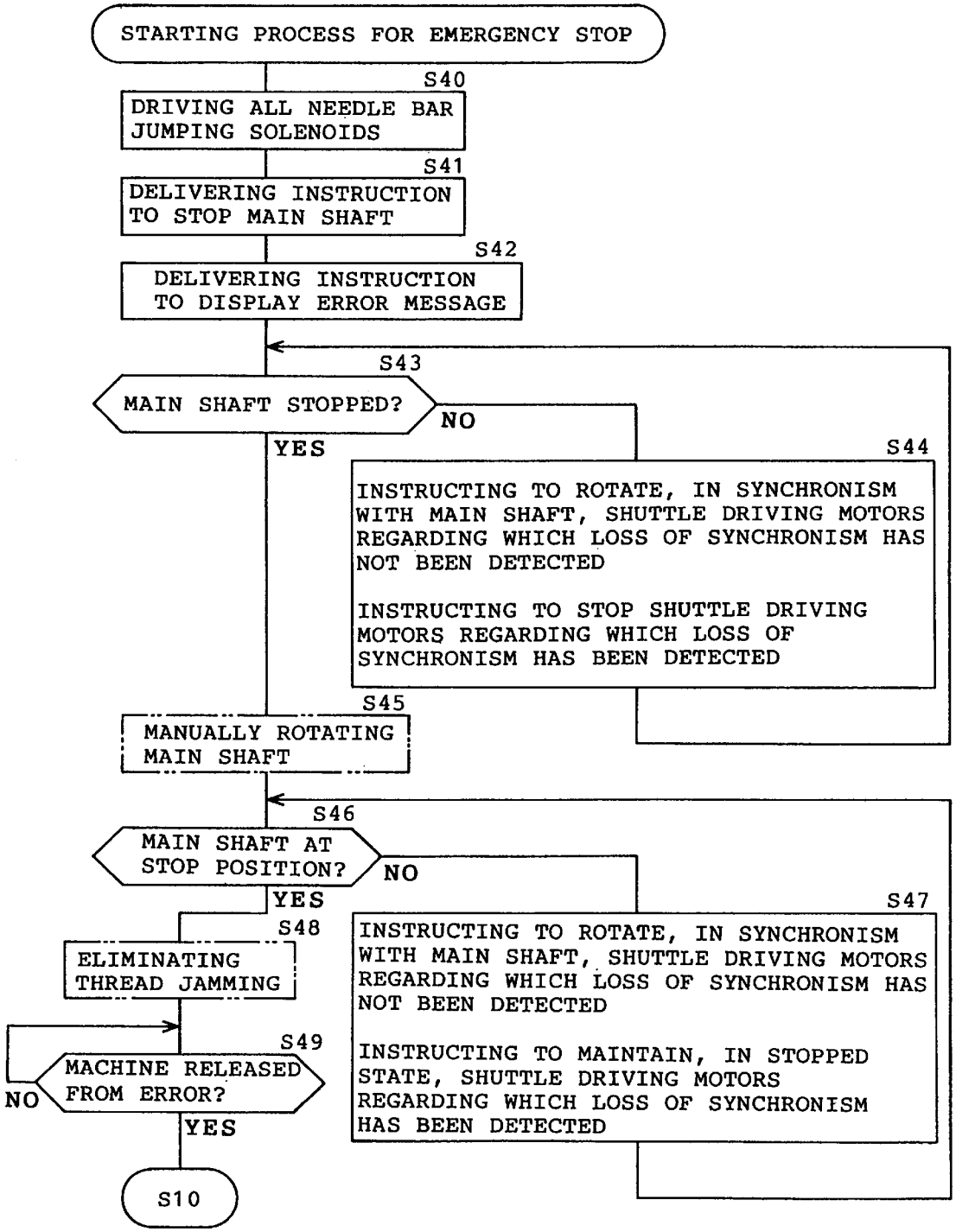
FIG. 13 is a schematic flowchart explaining a routine of emergency stop process.

The process for hook shaft synchronous drive will now be described with reference to FIG. 12. Upon start of this process, the main shaft rotation signal delivered by the rotary encoder 112 is usually counted so that data of the rotary position of the main shaft 17 is entered at step S30. For the purpose of the synchronous rotation with the main shaft 17, a judgment is made at step S31 whether the timing has been reached for the drive of each hook shaft 60 by one step. When the timing has been reached (YES at step S31), each shuttle driving motor 58 is driven by one step at step S32. For confirmation of rotation of each hook shaft 60, the count I of the counter for counting the number of drive steps of each shuttle driving motor 58 is incremented at step S33. Then, a judgment is made at step S34 as to whether the hook shaft rotation signal delivered by the rotary encoder 65 has changed. In the case where the hook shaft rotation signal has not changed (NO at step S34), the control is finished when the count I is at or below a predetermined value P, for example, the value between 10 and 15 (YES at step S35). The control then returns to step S25 for the sewing process (see FIG. 11). On the other hand, when the hook shaft rotation signal has changed (YES at step S34), the count I is cleared at step S36 since the hook shaft 60 is reliably being driven. The control is then completed and the control returns to step S25 for the sewing process (see FIG. 11).

When thread jamming occurs in any one of the bed units 10 to 12, the shuttle driving motor 58 driving the full-turn shuttle 59 with the thread jamming loses its synchronism with the main shaft 17 or is desynchronized. Upon occurrence of the thread jamming, the count I is larger than a predetermined value P. A negative judgment is made (NO at step S35) when the count I is larger than the predetermined value P or when a predetermined amount of loss of synchronism or more is detected. As a result, a process for emergency stop (see FIG. 13) is executed at step S37. The steps S33 to S35 constitute loss-of-synchronism detecting means in the invention. Furthermore, the process for the emergency stop constitutes emergency stop control means in the invention.

Upon start of the emergency stop process, all the needle bar jumping solenoids 41 of the respective embroidery machine units M1 to M3 are driven for a predetermined time at step S40. Consequently, each vertically moving member 27 is rotated to assume the jumping position so that each needle bar 21 of the embroidery machine units M1 to M3 is caused to jump up to the needle upper position. Simultaneously, the hook shaft control device 150 issues to the machine control device 100 a main shaft drive stop instruction, at step S41. The machine control device 35 supplies a brake signal to the drive circuit 11 such that the machine motor 110 is stopped. Then, the hook shaft control device 150 issues to the machine control device 100 a display instruction so that the error message indicating the emergency stop is displayed on the display 8*a* at step S42.

Based on the main shaft rotation signal delivered by the rotary encoder 112, a judgment is made at step S43 as to whether the main shaft 17 has been stopped. When the main shaft 17 has not been stopped (NO at step S43), the hook shaft control device 150 issues to the machine control device 100 an instruction to drive the normal shuttle driving motor or motors 58 in synchronism with the main shaft 17 (step S44). The normal motors refer to those with respect to which the loss of synchronism has not been detected. The hook shaft control device 150 further issues to the machine control device 100 an instruction to stop the abnormal shuttle driving motor or motors 58 with respect to which the loss of synchronism has been detected (step S44). Accordingly, one or more of the shuttle driving motors 58 are driven in synchronism with the main shaft 17 (namely, the machine motor 110) so as to be stopped in synchronism with the vertical movement of the corresponding sewing needles 22. Consequently, the collision of the shuttle against the needle can reliably be prevented. Furthermore, since one or more of the shuttle driving motors 58 with respect to which the loss of synchronism has been detected are promptly stopped, an excessive drive of the shuttle driving motors 58 can be prevented, and the thread jamming can be prevented from being further worsened.

When stopped by the above-described emergency stop control (YES at step S44), the main shaft 17 stops at any position other than the predetermined sewing start position (about 100-degree position) in almost all the cases. In these cases, the operator manually turns the manually operated pulley according to the error message so that the main shaft 17 is rotated to assume the predetermined stop position (step S45). Then, a judgment is made at step S46 as to whether the main shaft 17 assumes the 100-degree stop position. When the main shaft 17 is not located at the predetermined stop position (NO at step S46), the hook shaft control device 150 issues to the machine control device 100 an instruction to drive the normal shuttle driving motor or motors 58 in synchronism with the main shaft 17 (namely, the machine motor 110) until the main shaft 17 assumes the predetermined stop position (step S47). The hook shaft control device 150 further issues to the machine control device 100 an instruction to maintain the abnormal shuttle driving motor or motors 58 in the stopped state (step S47). Accordingly, one or more of the shuttle driving motors 58 with respect to which the loss of synchronism has not been detected are rotated in synchronism with the main shaft 17. The shuttle driving motors 58 are rotated in synchronism with the main shaft 17 in the case where the main shaft 17 is manually turned to assume the predetermined stop position for the re-sewing when the thread take-up levers have been lowered and the needle thread loops 47*a* have been formed on the full-turn shuttles 59 upon the emergency stop of the main shaft 17. Each needle thread loop 47*a* is detached from the corresponding full-turn shuttle 59 such that stitch formation by normal thread tightening is executed. Consequently, an excessive amount of needle thread can be prevented from remaining under the throat plate. This can prevent occurrence of thread jamming upon re-start of the sewing. Furthermore, since the shuttle driving motor or motors 58 with respect to which the loss of synchronism has been detected are maintained in the stopped state, the shuttle driving motors 58 connected to the full-turn shuttles 59 each with thread jamming can be prevented from being excessively driven, and the thread jamming can be prevented from being further worsened.

When the main shaft 17 has been located at the stop position, the affirmative determination is made (YES at step S46), and the thread jamming is eliminated from the full-turn shuttles 59 by the operator (step S48). When a finish switch etc. is operated so that the machine is released from the error state (YES at step S49), the control is finished, returning to the sewing control (see FIG. 9) at step S10. Thereafter, step S10 and the subsequent steps are executed so that the sewing control is re-started.

When the thread cutting is not executed at the final stitch according to the instruction from the machine control device 100 (NO at step S14), the hook shaft synchronous driving process is executed until the main shaft 17 assumes the 360-degree position (step S16 and NO at step S17). The control sequence returns to step S10 when the main shaft 17 assumes the 360-degree rotational position such that the beaks 59*c* are prevented from collision against the sewing needles 22 (YES at step S17). On the other hand, when the thread cutting is executed (YES at step S14), the thread cutting process is executed by the above-described thread cutting mechanism 80 from the 270-degree rotational position of the main shaft 17 (step S15). The control sequence returns to step S10 upon completion of the thread cutting.

According to the above-described multihead embroidery machine M, the emergency stop is effected with respect to the machine motor 110 and the shuttle driving motors 58 when the loss of synchronism due to the thread jamming etc. has been detected regarding at least one of the shuttle driving motors 58 of any one of the bed units 10 to 12 during the sewing or when at least of the shuttle driving motors has been in an abnormal condition. In the emergency stop, the shuttle driving motor or motors 58 regarding which the loss of synchronism has not been detected are driven in synchronism with the main shaft 17 until it is stopped. Accordingly, the full-turn shuttles 59 are driven in synchronism with the vertical movement of the sewing needles 22 until the main shaft 17 is stopped. Consequently, the full-turn shuttles 59 can reliably be prevented from collision against the sewing needles 22 even when the jumping of the needle bars 21 are delayed. Furthermore, the shuttle driving motors 58 regarding which the loss of synchronism has been detected are promptly stopped in the emergency stop in the abnormal condition. Consequently, the shuttle driving motors 58 can be prevented from being excessively driven, and the thread jamming can be prevented from being further worsened.

The manual pulley is operated to rotate the main shaft 17 to the predetermined position after the loss of synchronism has been detected (detection of abnormal condition) such that the emergency stop of the main shaft 17 has been effected. In this case, the shuttle driving motors 58 of the bed units 10 to 12 regarding which the loss of synchronism has not been detected are rotated in synchronism with the main shaft 17 (namely, the machine motor 110). The stitch formation by the normal thread tightening is executed even when each needle thread loop 47*a* is formed on the corresponding full-turn shuttle 59. Consequently, an excessive amount of needle thread can be prevented from remaining under the throat plate. This can prevent occurrence of thread jamming upon re-start of the sewing. Furthermore, the shuttle driving motor or motors 58 with respect to which the loss of synchronism has been detected are maintained in the stopped state when the manual pulley is operated to rotate the main shaft 17 to the predetermined position. Consequently, the shuttle driving motors 58 connected to the full-turn shuttles 59 each with thread jamming can be prevented from being excessively driven, and the thread jamming can be prevented from being further worsened.

In a modified form of the foregoing embodiment, the machine motor 110 may mechanically be rotated at low speeds at step S45 of the emergency stop process (FIG. 13) so that the main shaft 17 is rotated to the stop position, instead of the manual rotation of the main shaft 17. Furthermore, an instruction to stop the main shaft 17 at the initially set 100-degree position may be delivered at step S41 of the emergency stop process, so that the main shaft 17 is stopped at the 100-degree position at step S44. Between steps S43 and S45 of the emergency stop process, at least the shuttle driving motors 58 regarding which the loss of synchronism has not been detected may be rotated without synchronism with the main shaft 17 to the position where the needle thread loops are detached from the full-turn shuttles 59 or the about 360-degree position of the main shaft 17. In this constitution, the instruction to rotate, in synchronism with the main shaft 17, the shuttle driving motors regarding which the loss of synchronism has not been detected can be eliminated at step S47.

In another modified form, the shuttle driving motors 58 regarding which the loss of synchronism has been detected may be controlled to be rotated together with those regarding which the loss of synchronism has not been detected, as though they are in synchronism with the main shaft 17 or so that they are synchronized with the main shaft 17 to a most possible extent. Furthermore, the main shaft 17 is manually rotated to the about 100-degree position where the sewing needles 22 are raised, at step S45. Accordingly, at step S47, each of the shuttle driving motors 58 regarding which the loss of synchronism has not been detected may be controlled to be rotated in the normal direction to thereby assume a predetermined sewing start position corresponding to the stop position of the main shaft 17. Additionally, half-turn shuttles may be used instead of the full-turn shuttles 59. The invention may be applied to a single embroidery machine.

The invention may further be applied to various types of sewing machines in which shuttles are driven by a shuttle driving motors independent of the sewing machine motor.

In the foregoing embodiment, the ROM 102 of the machine control device 100 and the ROM 152 of the hook shaft control device 150 store the programs for operating the multihead embroidery machine M or for accomplishing the sewing control means, the loss-of-synchronism detecting means, and the emergency stop control means. For example, these programs may be stored in an external card ROM, instead, so that the CPU 101 of the machine control device 100 and the CPU 151 of the hook shaft control device 150 are operated on the basis of the programs stored in the external card ROM. Furthermore, the machine control device 100 and the hook shaft control device 150 may be provided with EEPROMs so that the programs stored in the card ROM are transferred to the EEPROMS, and thereafter, the CPUs 101 and 151 are operated on the basis of the programs transferred to the EEPROMs, respectively. Furthermore, the multihead embroidery machine M may be provided with a hard disk system and a floppy disk drive so that the programs are stored in the hard disk system. In this case, the programs are preferably stored in floppy disks, and the floppy disks are preferably attached to the floppy disk drive so that the programs are installed on the hard disk system of the multihead embroidery machine. Furthermore, the programs may be stored in a CD-ROM and the multihead embroidery machine may be provided with a CD-ROM drive so that the programs are installed through the CD-ROM on the multihead embroidery machine. Additionally, a recording medium for storing the programs should not be limited to the external card ROM, floppy disk and CD-ROM. Other recording media may be used for the purpose. Furthermore, the machine control device 100 and the hook shaft control device 150 may be provided with flush memories (flush EEPROMs) so that the programs are written into them via communication lines connecting between a personal computer and the multihead embroidery machine, respectively. Furthermore, floppy disks may store the above-mentioned programs so that the programs are written into the flush memories.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A multihead sewing machine comprising:

a sewing machine motor;

a main shaft rotated by the sewing machine motor;

a plurality of sewing needles driven by the main shaft;

a plurality of shuttles for capturing thread loops in cooperation with the sewing needles respectively, each shuttle having a hook shaft;

a plurality of shuttle driving motors for rotating the hook shafts of the shuttles independent of the sewing machine motor respectively;

sewing control means for controlling the sewing machine motor and the shuttle driving motors so that the sewing machine motor and each shuttle driving motor are rotated in synchronism with each other;

loss-of-synchronism detecting means for detecting loss of synchronism of each shuttle relative to the corresponding sewing needle; and emergency stop control means for instructing the sewing control means to stop rotation of the main shaft in an abnormal condition wherein the loss of synchronism has been detected with respect to at least one of the shuttles by the loss-of-synchronism detecting means, the emergency stop control means further instructing the sewing control means to rotate, in synchronism with the main shaft, at least the shuttle driving motor or motors other than the shuttle driving motor regarding which the loss of synchronism has been detected, until rotation of the main shaft stops.

2. A multihead sewing machine according to claim 1, wherein the emergency stop control means instructs the sewing control means to rotate, in synchronism with the main shaft, at least the shuttle driving motor or motors other than the shuttle drive motor regarding which the loss of synchronism has been detected, when the main shaft is manually rotated after stop thereof in the abnormal condition.

3. A multihead sewing machine according to claim 1, wherein the emergency stop control means instructs the sewing control means to stop the shuttle driving motor regarding which the loss of synchronism has been detected in the abnormal condition.

4. A multihead sewing machine according to claim 2, wherein the emergency stop control means instructs the sewing control means to stop the shuttle driving motor regarding which the loss of synchronism has been detected in the abnormal condition.

5. A multihead sewing machine according to claim 1, wherein the emergency stop control means instructs the sewing control means to stop the main shaft so that the main shaft is driven to assume a predetermined rotational position for start of the sewing when or after the main shaft has been stopped in the abnormal condition, and wherein the emergency stop control means instructs the sewing control means to rotate, in synchronism with the main shaft, at least the shuttle driving motor or motors other than the shuttle driving motor regarding which the loss of synchronism has been detected, when the main shaft is driven to assume the predetermined rotational position.

6. A multihead sewing machine according to claim 3, wherein the emergency stop control means instructs the sewing control means to stop the main shaft so that the main shaft is driven to assume a predetermined rotational position for start of the sewing when or after the main shaft has been stopped in the abnormal condition, and wherein the emergency stop control means instructs the sewing control means to rotate, in synchronism with the main shaft, at least the shuttle driving motor or motors other than the shuttle driving motor regarding which the loss of synchronism has been detected, when the main shaft is driven to assume the predetermined rotational position.

7. A multihead sewing machine according to claim 1, wherein the emergency stop control means instructs the sewing control means to rotate, without synchronization with the main shaft, at least the shuttle driving motor or motors other than the shuttle driving motor regarding which the loss of synchronism has been detected, so that the motor or motors are rotated to assume a position or positions at which a needle thread loop or loops are disengaged from the shuttle or shuttles respectively, after the main shaft has been stopped in the abnormal condition.

8. A multihead sewing machine according to claim 1, wherein the emergency stop control means instructs the sewing control means to rotate, in synchronism with the main shaft, at least the shuttle driving motor or motors other than the shuttle driving motor regarding which the loss of synchronism has been detected, when the main shaft is manually or mechanically rotated after stop thereof in the abnormal condition.

9. A multihead sewing machine according to claim 8, wherein the emergency stop control means instructs the sewing control means to maintain in a stopped state the shuttle driving motor regarding which the loss of synchronism has been detected, when the main shaft is manually or mechanically rotated.

10. A multihead sewing machine comprising:

a sewing machine motor;

a main shaft rotated by the sewing machine motor;

a plurality of sewing needles driven by the main shaft;

a plurality of shuttles for capturing thread loops in cooperation with the sewing needles respectively, each shuttle having a hook shaft;

a plurality of shuttle driving motors for rotating the hook shafts of the shuttles independent of the sewing machine motor respectively;

sewing control means for controlling the sewing machine motor and the shuttle driving motors so that the sewing machine motor and each shuttle driving motor are rotated in synchronism with each other;

loss-of-synchronism detecting means for detecting loss of synchronism of each shuttle relative to the corresponding sewing needle; and emergency stop control means for instructing the sewing control means to rotate, in synchronism with the main shaft, at least the shuttle driving motor or motors other than the shuttle driving motor regarding which the loss of synchronism has been detected by the loss-of-synchronism detecting means, when the main shaft is stopped and subsequently rotated manually or mechanically in an abnormal condition wherein the loss of synchronism has been detected with respect to the shuttle driving motor.

11. A multihead sewing machine according to claim 10, wherein the emergency stop control means instructs the sewing control means to maintain in a stopped state the shuttle driving motor regarding which the loss of synchronism has been detected, when the main shaft is manually or mechanically rotated.

12. A storage medium for storing a program for operating a multihead sewing machine comprising a sewing machine motor, a main shaft rotated by the sewing machine motor, a plurality of sewing needles driven by the main shaft, a plurality of shuttles for capturing thread loops in cooperation with the sewing needles respectively, each shuttle having a hook shaft, and a plurality of shuttle driving motors for rotating the hook shafts of the shuttles independent of the sewing machine motor respectively, the program accomplishing the functions of:

sewing control means for controlling the sewing machine motor and the shuttle driving motors so that the sewing machine motor and each shuttle driving motor are rotated in synchronism with each other;

loss-of-synchronism detecting means for detecting loss of synchronism of each shuttle relative to the corresponding sewing needle; and emergency stop control means for instructing the sewing control means to stop rotation of the main shaft in an abnormal condition wherein the loss of synchronism has been detected with respect to at least one of the shuttles by the loss-of-synchronism detecting means, the emergency stop control means further instructing the sewing control means to rotate, in synchronism with the main shaft, at least the shuttle driving motor or motors other than the shuttle driving motor regarding which the loss of synchronism has been detected, until rotation of the main shaft stops.

13. A storage medium according to claim 12, wherein the emergency stop control means instructs the sewing control means to rotate, in synchronism with the main shaft, at least the shuttle driving motor or motors other than the shuttle drive motor regarding which the loss of synchronism has been detected, when the main shaft is manually rotated after stop thereof in the abnormal condition.

14. A storage medium according to claim 12, wherein the emergency stop control means instructs the sewing control means to stop the shuttle driving motor regarding which the loss of synchronism has been detected in the abnormal condition.

15. A storage medium according to claim 12, wherein the emergency stop control means instructs the sewing control means to stop the main shaft so that the main shaft is driven to assume a predetermined rotational position for start of the sewing when or after the main shaft has been stopped in the abnormal condition, and wherein the emergency stop control means instructs the sewing control means to rotate, in synchronism with the main shaft, at least the shuttle driving motor or motors other than the shuttle driving motor regarding which the loss of synchronism has been detected, when the main shaft is driven to assume the predetermined rotational position.

* * * * *